United States Patent [19]

Cacioppo et al.

[11] Patent Number: 4,782,580

[45] Date of Patent: Nov. 8, 1988

[54] METHOD OF MANUFACTURE OF SLIP RING ASSEMBLY

[75] Inventors: Joseph C. Cacioppo, Akron; Donald R. Wuerzer, Uniontown; Peter J. Piglia, Stow, all of Ohio

[73] Assignee: National Machine Company, Inc., Stow, Ohio

[21] Appl. No.: 82,689

[22] Filed: Aug. 3, 1987

Related U.S. Application Data

[62] Division of Ser. No. 857,319, Apr. 30, 1986, Pat. No. 4,705,976.

[51] Int. Cl.[4] ..... H01R 43/10

[52] U.S. Cl. ..... 29/597; 156/293; 156/306.9; 264/258

[58] Field of Search ..... 29/597; 310/232, 237; 156/245, 293, 306.9; 264/258

[56] References Cited

U.S. PATENT DOCUMENTS

| | | | |
|---|---|---|---|
| 2,696,570 | 12/1954 | Pandapas | 310/232 |
| 2,926,326 | 2/1960 | Boily et al. | 310/232 |
| 3,038,138 | 6/1962 | Peterson | 310/232 |
| 3,066,386 | 12/1962 | Filipczak | 310/232 |
| 3,314,038 | 4/1967 | Rutten | 310/232 |
| 3,430,338 | 3/1969 | Flaherty | 29/597 |
| 3,464,108 | 9/1969 | Boodman et al. | 29/597 |
| 4,294,643 | 10/1981 | Tadewald | 156/293 |
| 4,684,179 | 8/1987 | Freeman | 29/597 |

*Primary Examiner*—P. W. Echols

*Attorney, Agent, or Firm*—Renner, Kenner, Greive, Bobak, Taylor & Weber

[57] ABSTRACT

A method for making a slip ring assembly contemplates welding to one face of each of a plurality of varying diameter concentric conducting rings a plurality of electrically conducting studs, positioning a plurality of the rings within grooves inscribed in a first mold section in an accurately spaced concentric arrangement with respect to each other, surrounding the rings radially interiorly thereof with one or more pre-cut insulating plies, placing insulating material in the spaces between the concentrically spaced rings and radially outwardly thereof, positioning a plurality of pre-cut insulating plies axially of the rings and insulating material aligned to permit passage of the studs through pre-cut holes in the plies, closing a second mold section on the first mold section, and heating the assembly under pressure in the mold sections until the assembly is cured. The manufactured slip ring assembly (10) has a plurality of concentric spaced conducting rings (16, 17, 18), one face (19, 20, 21) of each of the rings being exposed for engagement by brushes with the other face having a plurality of electrically conducting projecting studs (31) attached thereto, an insulating material (25) isolates each of the rings and encompasses a portion of the studs, and a recess (33) on the studs within the insulating material to provide a mechanical interlock of the studs relative to the insulating material and the rings.

13 Claims, 2 Drawing Sheets

METHOD OF MANUFACTURE OF SLIP RING ASSEMBLY

This application is a division of application Ser. No. 857,319, filed Apr. 30, 1986 now U.S. Pat. No. 4,705,976.

TECHNICAL FIELD

The present invention relates generally to slip ring assemblies and methods for the manufacture of said assemblies which are used with brushes to electrically connect fixed and relatively rotating elements. More particularly, the invention relates to slip ring assemblies which are manufactured for applications requiring a long service life and exacting performance over the service life. More specifically, the invention relates to a slip ring assembly which meets extremely close tolerances and possesses strength and weight characteristics of a type suitable even for usage in the aircraft industry.

BACKGROUND OF THE INVENTION

Slip rings have long been employed in applications where electrical power must be provided to an electrically powered device which is in intermittent or constant rotation relative to the power source. Normally the slip rings are mounted on the rotating element with a brush module fixedly mounted in conjunction with the power source and in proximity to the slip rings and having an individual brush element in engagement with each of the rings of the slip ring assembly. There are, of course, numerous different applications where slip rings have been commonly used, with the slip rings being designed to take into account particular facets of the environment or the operating conditions under which the apparatus operates. In most applications there is considerable latitude in terms of the design of a slip ring assembly in that size, weight, cost and related considerations are not subject to stringent limitations.

In a general sense, slip rings have characteristically been manufactured by methods requiring a substantial number of machining operations, many of these operations requiring precise equipment and/or workmanship. In some instances the respective slip rings have been initially machined to the appropriate dimensions. Thereafter, a metallic disk or base is machined to accurate tolerances for the mounting of the assembly and a portion of the disk or base is then cut away in precise areas to receive the slip rings. The cut-away areas characteristically are filled with an electrically nonconductive molding material such as a plastic which forms a holding element for the rings and simultaneously forms insulating elements around the slip rings in the form of an insulating backing and concentric insulating elements disposed between the spaced rings. It is reportedly difficult to arrange rings accurately concentrically of the base and maintain nearly perfect alignment during the molding operations. Subsequent significant machining is needed to remove molded nonconductive plastic material from the rings and to produce the necessary true concentric position and close tolerance flat face. In addition, certain plastics employed as slip ring insulating materials have highly different coefficients of expansion than the slip rings and the metallic base such that the finished ring assembly may be subject to warping with temperature variations during processing or thereafter.

Another approach to the manufacture of slip rings involves the use of a molded plastic disk or plate which is machined to contain concentric grooves. Individual slip rings are fabricated and inserted in the concentric grooves to be secured as by cementing. It is reportedly difficult to obtain a sufficiently precise match between the size of rings and the grooves and to maintain the rings sufficiently accurately concentric. A modification of this method contemplates an electro deposit of metal to fill the machined grooves of the plastic base. The machining of the plastic is still required and the plastic base is likely to become contaminated with the plating solution and degrade the electrical insulating properties of the plastic in electro depositing or comparable complex processes.

In order to overcome the quality control problems associated with processes of the type discussed above the art has resorted to even more complex and extensive machining operations to achieve the extent of accuracy and quality control required of slip ring assemblies. An example of such a process is the formulation of deep grooves in a disk of material where the intermittent ribs are to constitute the slip rings, the deep grooves forming intermittent ribs projecting from a retained base. The grooves are subsequently filled with an insulating material and a backing member or plate is attached covering the grooves and the ribs. Thereafter the original base which maintained the ribs in true spaced concentricity is entirely machined away to leave the ribs projecting from the later attached backing member or plate. This process has the obvious disadvantage of wasting great quantities of material and requiring extensive machining steps.

It is thus believed that prior art processes have not achieved the potential for construction of highly accurate slip ring assemblies which can be manufactured without numerous and normally extensive machining steps requiring highly skilled craftsmanship. This has apparently remained the situation despite numerous efforts toward the development of more accurate and sophisticated slip ring assemblies.

A further problem attendant the manufacture of slip ring assemblies is the attachment of studs normally at spaced intervals around a slip ring to which electrical connections from the power supply are subsequently attached. In some instances studs are attached by welding or soldering operations which with or without associated protective structure may become damaged or separated from the slip ring during shipping, installation or in the operational environment for the slip ring assembly. In other instances, slip rings may be made removable by securing them to a base with screws or by effecting a crimping of a projecting post. Since ring elements thus mounted are subject to accidental loosening or removal, temporary fastening elements of this nature are not normally considered to be appropriate for high performance, close tolerance applications.

DISCLOSURE OF THE INVENTION

Therefore, an object of the present invention is to provide a method for the manufacture of a slip ring assembly which can be readily fabricated to close tolerances for high performance utilization such as in conjunction with aircraft propeller deicing equipment and similar applications. Another object of the invention is to provide a method of manufacturing such a deicing slip ring assembly which entails a minimum of machining steps and in which such machining is of limited extent. A further object of the invention is to provide a method for manufacturing a slip ring assembly which has comparable tolerances to conventional assemblies having a machined metallic base but which is composed entirely of a plurality of plies of plastic insulating material. A further object of the invention is to provide a method of manufacture of a slip ring assembly wherein the resultant assembly is lighter than comparable slip ring assemblies having a metallic base but is of equivalent strength, rigidity and accuracy. A still further object of the present invention is to provide a method of manufacture of a slip ring assembly which requires the performance of fewer operations by highly skilled machine shop personnel.

Yet another object of the present invention is to provide a slip ring assembly in which the electrical studs are both welded to the individual slip rings and nonmovably axially molded in the insulating material backing the slip rings. Yet another object of the invention is to provide a slip ring assembly having a projecting electrical stud to which electric connections and protective sheaths can be readily applied. Still another object of the invention is to provide a slip ring assembly wherein partial attachment of the electrical stud relative to the slip rings is effected in the course of the construction of the slip ring assembly such as to become an integral part of the entire assembly.

In general, a method for making a slip ring assembly according to the concepts of the present invention contemplates welding to one face of each of a plurality of varying diameter concentric conducting rings a plurality of electrically conducting studs, positioning a plurality of the rings within grooves inscribed in a first mold section in an accurately spaced concentric arrangement with respect to each other, surrounding the rings radially interiorly thereof with one or more pre-cut insulating plies, placing insulating material in the spaces between the concentrically spaced rings and radially outwardly thereof, positioning a plurality of pre-cut insulating plies axially of the rings and insulating material aligned to permit passage of the studs through pre-cut holes in the plies, closing a second mold section on the first mold section, and heating the assembly under pressure in the mold sections until the assembly is cured.

The manufactured slip ring assembly has a plurality of concentric spaced conducting rings, one face of each of the rings being exposed for engagement by the brushes with the other face having a plurality of electrically conducting projecting studs attached thereto, an insulating material isolates each of the rings and encompasses a portion of the studs, and means on the studs within said insulating material provide a mechanical interlock of the studs relative to the insulating material and the rings.

PREFERRED EMBODIMENT FOR CARRYING OUT THE INVENTION

Figure 1:
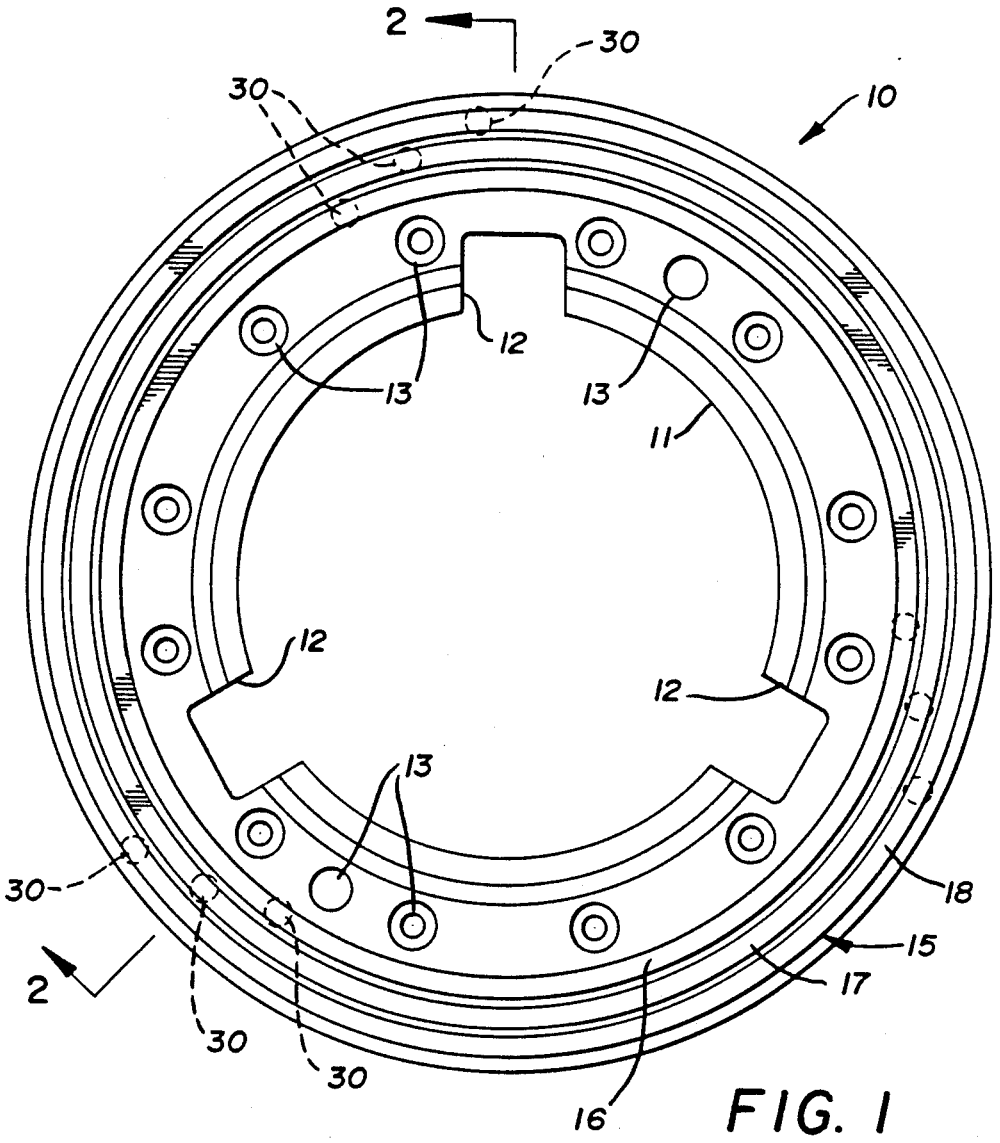
FIG. 1 is a top plan view of a slip ring assembly embodying the concepts of the present invention and depicting particularly the slip rings and related assembly mounting elements.
Figure 2:
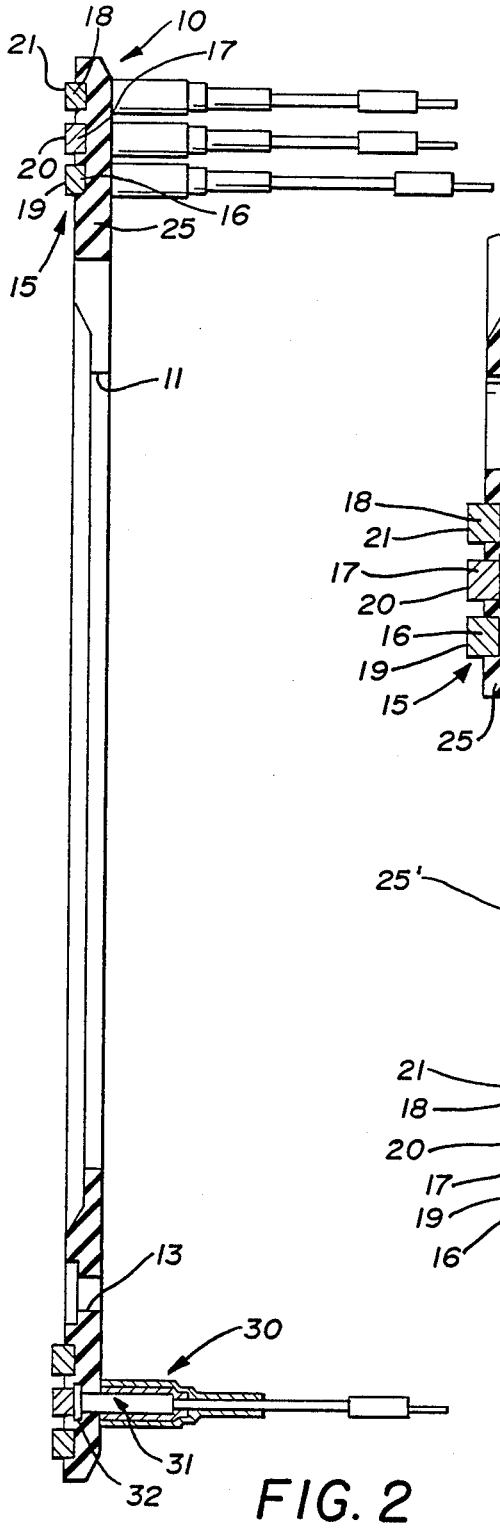
FIG. 2 is a cross-sectional view of the slip ring assembly of FIG. 1 taken substantially along the line 2—2 of FIG. 1 and depicting certain electrical attachments thereto.

A slip ring assembly embodying the concepts of the present invention is generally indicated by the numeral 10 in FIGS. 1 and 2 of the drawings. As shown, the slip ring assembly 10 is of a generally disk-like configuration in that the axial dimension or thickness is relatively small as compared with the diameter or radial dimension of the disk. The exact disk diameter, thickness and other dimensional characteristics are, of course, dictated in substantial part by the size and configuration of the rotating part upon which slip ring assembly 10 is positioned and its relationship to the fixed member carrying conventional slip ring brushes (not shown). In many instances the slip ring assembly 10 may be provided with a central aperture 11 through which a propeller shaft or other rotating member may project as constituting a mechanical interconnection between the fixed member and the movable member mounting the assembly 10.

In addition to requiring precision construction of the slip ring assembly itself, it is necessary to provide a precision mounting of the slip ring assembly 10 on a rotating member such as an aircraft propeller hub to insure that the interaction of the slip ring brushes with the slip ring assembly 10 is a precise constant pressure engagement to insure maintenance free operation for extended operating periods. For purposes of effecting nonrotatable mounting of the slip ring assembly 10 relative to the propeller or other moving member on which it is mounted, the slip ring assemblies are customarily provided with positioning cutouts 12 which accurately align the slip ring assembly 10 for receipt of the various connectors and elements as described hereinafter. As best seen in FIG. 1, the slip ring assembly 10 has three cutouts 12 which are positioned at equal angular increments, namely, 120° about the central through aperture 11. Disposed angularly to either side of the cutouts 12 are a plurality of apertures 13 which provide for the insertion of suitable fasteners for firmly attaching slip ring assembly 10 in a precise position on a rotating element. As shown, the apertures 13 may be spaced through increments of approximately 15° to 30° about the circumference of slip ring assembly 10 to insure precise positioning of all areas of the assembly 10. As shown, the apertures 13 may be positioned generally in the radially inner half of the slip ring assembly 10 such that they are substantially displaced radially outwardly of the aperture 11 but well spaced from other elements of slip ring assembly 10.

Positioned normally radially outwardly of the apertures 13 are a plurality of slip rings, generally indicated by the numeral 15. As shown, there are three precisely concentrically positioned slip rings with a radially inner slip ring 16, an intermediate slip ring 17 and a radially outer slip ring 18. It is to be appreciated that more or less slip rings may be provided to handle the particular wiring requirements for the transfer of electrical energy between particular fixed and moving elements. As seen in FIGS. 1 and 2, the slip rings 16, 17 and 18 are precisely fabricated annular rings which have axially outer surfaces 19, 20 and 21, respectively, which are engaged by brushes (not shown) from a cooperating slip ring brush. The axial surfaces 19, 20, 21 must for optimum operation be in precise concentric positioning with respect to slip ring assembly 10, must be radially positioned at a precise distance radially of the slip ring assembly 10, and must lie in a plane which is directed exactly radially of the slip ring assembly 10.

This positioning, orientation and attachment of the slip rings 15 is accomplished in a manner hereinafter described in the insulating member 25 which constitutes the entirety of slip ring assembly 10 except for slip rings 15 and certain attachments thereto described hereinafter. As can be generally seen in FIGS. 1 and 2, the insulating material is positioned radially inwardly and outwardly of the apertures 13, radially inwardly and outwardly of the slip rings 15 and interposed between the slip rings 16, 17, 18. As best seen in FIG. 2, the individual slip rings 16, 17, 18 are electrically isolated by the insulating member 25 and extend a distance axially outwardly therefrom. It is to be appreciated that the axial positioning of rings 15 relative to the insulating body 25 may be projecting to various extents, flush, or recessed depending upon the brushes employed to engage the slip rings 15 and various operating and design parameters which must be met for a particular slip ring assembly 10.

The electrical interconnection between the slip rings 15 and the wiring for electrical components to be driven in the rotating member is effected by an electrical connector assembly, generally indicated by the numeral 30. A plurality of electrical connectors 30 are preferably attached to each of the individual slip rings 16, 17 and 18. As seen in FIG. 1, three electrical connector assemblies 30 are attached circumferentially of each of the slip rings 16, 17 and 18. It is also to be noted that for ease of access to the electrical connector assemblies 30 and other reasons the electrical connectors 30 of each slip ring are preferably angularly offset, e.g., through an angle of 10° or more, from the proximate electrical connector 30 of adjacent slip rings. The construction of each of the electrical connectors 30 may for convenience be identical.

Figure 3:
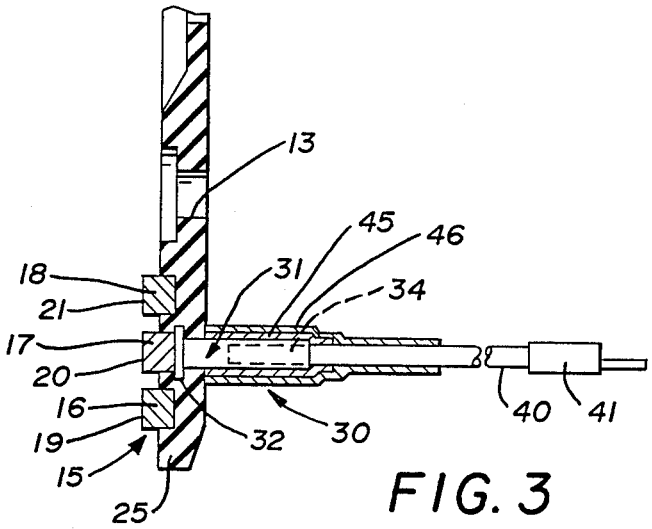
FIG. 3 is an enlarged fragmentary cross-sectional view of the lower portion of FIG. 2 depicting additional details of the slip ring assembly and related electrical attachments.

As best seen in FIGS. 2 and 3, the electrical connectors 30 interrelate with the insulating material 25 and slip rings 15 by an elongated cylindrical stud, generally indicated by the numeral 31. As shown, the stud has an enlarged head portion 32 which abuts against and is attached to the axial face of slip rings 15 opposite the brush engaging faces 19, 20, 21. The head 32 is preferably of a diameter which is slightly greater than the radial dimension of the slip rings 16, 17 and 18 for a purpose detailed hereinafter. The enlarged head portion 32 of the stud 31 may be attached to the slip rings 15 by any method which provides a good mechanical and electrical interconnection of the parts, as for example resistance welding.

The stud 31 has the head 32 constructed of a sufficient axial length such as to provide a substantially rigid projection on the stud 31. Due to the fact that the area axially surrounding head 32 becomes filled with insulating material 25 during the molding process, as described hereinafter, the stud 31 and thus electrical connector 30 is firmly mechanically interlocked within the insulating material 25 in a manner providing resistance to movement of the stud 31 relative to insulating material 25 in any direction including axially of the slip ring assembly 10.

The stud 31 has at the extremity opposite the enlarged head 32 an internal bore 34. The internal bore 34 receives an electrical lead 40 of electrical connector 30 which may be soldered in place and perhaps crimped to insure a continuing mechanical and electrical interconnection. The extremity of electrical lead 40 opposite the internal bore 34 of stud 31 has an attached conventional electrical terminal 41 which may be soldered and/or crimped to similarly effect mechanical and electrical connection (see FIGS. 3 and 4). The joinder of the stud 31 and electrical lead 40 may be provided with protection from water or other environmental fluids and effects by a length of elastomeric tubing 45 which preferably extends from proximate the insulating material 25 to a position beyond the axially projecting extremity of stud 31 receiving lead 40. A second elastomeric tubing 46 may be attached outwardly of the elastomeric tubing 45 to afford additional protection thereto and to resist possible abrasion or other damage during shipping, installation and operation.

The method of the instant invention for producing the slip ring assembly 10 is described hereinafter in conjunction with the drawings. The joinder of the slip rings 15 with the stud 31 attached as previous described is effected in relation to the insulating material 25 by a molding process. For purposes of achieving a construction which has strength characteristics comparable to metals at weight reductions of 20–30%, a glass fiber reinforced epoxy insulating material has been found to constitute an exemplary material for the practice of the present invention. The molding process may be carried out in what is essentially a conventional two-piece mold, the configuration of which will be apparent to persons skilled in the art. The mold is prepared for the molding process of the instant invention by first cleaning and drying the mold parts in a conventional manner. Thereafter, the molds may be suitably treated with wax, mold release or other compounds well known to persons skilled in the art taking into account the materials of which the mold is constructed and the insulating material 25.

Thereafter, a set of slip rings 15 consisting of an outer ring 16, an intermediate ring 17 and inner ring 18 is placed in mating grooves in one of the mold parts. The various studs 31 which have been attached as described above on the various slip rings 15 are angularly positioned by rotationally moving the slip rings 15 to the position depicted in FIG. 1 or other predetermined locations. As will be appreciated by persons skilled in the art an alignment fixture may be employed at this time to effect and insure proper positioning of the studs.

Figure 4:
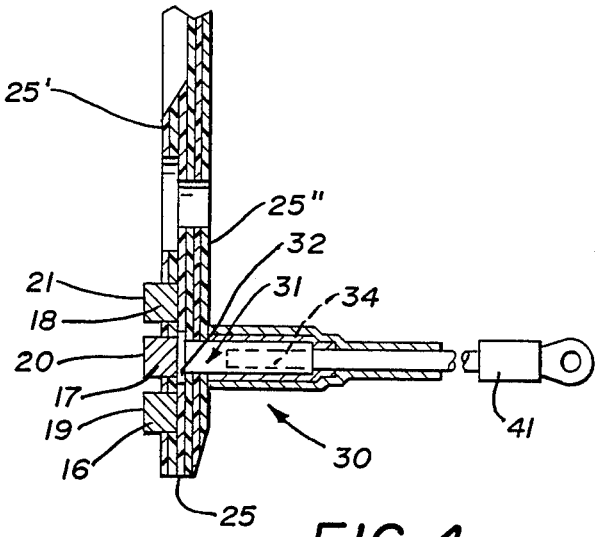
FIG. 4 is a view similar to FIG. 3 showing details of the lay-up of the insulating material plies and insulating material constituting a portion of the method of manufacturing the slip ring assembly depicted in FIGS. 1–3.

With the slip rings 15 thus positioned and rotationally aligned in the mold, lay-up of the insulation material 25 is commenced as depicted in FIG. 4. In order to effect accurate positioning of the molding material within the molds, the insulating material 25 is constituted primarily of a plurality of thin plies of molding material such as glass fiber reinforced epoxy. The plies may be on the order of 0.01 to 0.02 of an inch in thickness such that they can be readily handled and fabricated as by well known diecutting processes. The initial plies 25' (FIG. 4) are preferably cut to fill the area radially inwardly of the inner slip ring 18. The plies 25' are cut to exclude the center aperture 11 and fastener apertures 13 and terminate at the slip rings 15. Although circular plies could be cut for interpositioning between the slip rings 16, 17 and 18, and outwardly of the outer slip ring 16 it may be advantageous to manually insert a glass fiber reinforced epoxy roving into these areas to a depth equivalent to the depth of the plies 25' which is approximately the axial innerface of slip rings 15 opposite their projecting faces 19, 20, 21. Subsequent to the placement of these initial layers of insulating material 25, a further check may be made to insure that the projecting studs 31 have remained perfectly aligned as was effected prior to insertion of the initial ply layers.

Thereafter a plurality of additional plies 25'', cut to the size seen in FIG. 4, are introduced to overlie the slip rings 15, the underplies 25' and the roving. The plies 25'' may be of approximately identical material and thickness to the underplies 25'. It is to be noted that selected intermediate ones of the plies 25'' are cut in the area proximate the studs 31 to interfit in the annular recess 33 of the stud 31. Upon insertion of the insulating plies 25'' such that the slip ring assembly 10 assumes essentially the configuration depicted in FIGS. 3 and 4, by virtue of the ply lay-up described hereinabove, the fabrication of the slip ring assemblies 10 is completed.

The slip ring assembly 10 requires at this time only the closure of the mold and the curing and post curing operations which optimize the characteristics of the final product depending upon the particular insulating material which might be employed. In general, for a glass reinforced epoxy material, the closed mold would be placed in a preheated press at 300°–400° F. with a gradual application of pressure to insure the interengagement between the various plies 25', 25'' and any roving material employed, as well as a thorough distribution of insulating material 25 to every extremity of the conforming mold contour. Thereafter, the mold is maintained for a given time period at the curing temperature for the material, normally on the order of 300°–400° F. After adequate curing time, the mold is removed from the press and the final configuration slip ring assembly 10 is removed from the mold and preferably placed in a cooling fixture for a post cure for several hours while remaining at a temperature of 300°–400° F. Thereafter, the slip ring assembly 10 is cooled to room temperature in the cooling fixture before removal therefrom. The post cure takes into account the maintenance of dimensional stability of the assembly 10.

Upon removal of the slip ring assembly 10 from the cooling fixture it may be necessary only to remove such minor flashing as might exist on the completed part. Thereafter the axially outward surfaces 19, 20, 21 of the slip rings 15 are faced by lightly machining to remove any insulating material 25 which may be present thereon and to insure the final specified tolerances of the slip rings 15 in relation to the other components of the slip ring assembly 10.

Finally, the wiring involving the interpositioning of the electrical lead 40 in the stud 31 and the attachment of the electrical terminal 41 as detailed hereinabove is effected. Thereafter the elastomeric tubing 45, which may be a type of shrink tubing that reduces in size upon heating, and the elastomeric tubing 46 are positioned relative to stud 31 and electrical lead 40 to complete the electrical wiring of the slip ring assembly 10.

Thus it should be evident that the slip ring assembly and the method for manufacture thereof disclosed herein carries out the various objects of the invention set forth hereinabove and otherwise constitutes an advantageous contribution to the art. As may be apparent to persons skilled in the art, modifications can be made to the preferred embodiment disclosed herein without departing from the spirit of the invention, the scope of the invention being limited solely by the scope of the attached claims.

We claim:

1. A method for making a slip ring assembly comprising the steps of:

welding to one face of each of a plurality of varying diameter concentric conducting rings a plurality of electrically conducting studs;

positioning a plurality of said rings within grooves inscribed in a first mold section in an accurately spaced concentric arrangement with respect to each other;

surrounding said rings radially interiorly thereof with one or more pre-cut insulating plies;

placing insulating material in the spaces between said concentrically spaced rings and radially outwardly thereof;

positioning a plurality of pre-cut insulating plies axially of said rings and insulating material aligned to permit passage of said studs through pre-cut holes in said plies;

closing a second mold section on said first mold section; and heating the assembly under pressure in said mold sections until the assembly is cured.

2. A method according to claim 1 wherein said pre-cut insulating plies constitute a number of relatively thin plies.

3. A method according to claim 1 wherein the step of placing insulating material includes filling the spaces with a glass fiber and epoxy roving.

4. A method according to claim 1 including the step of applying mold release to said first and second mold sections prior to placing said rings and said insulating material therein.

5. A method according to claim 1 including the step of die-cutting the thin pre-cut concentric plies of insulating material.

6. A method according to claim 1 wherein said heating step includes placing the closed mold in a preheated press.

7. A method according to claim 6 wherein said heating under pressure includes slowly applying pressure to said mold parts.

8. A method according to claim 7 including the further steps of removing the slip ring assembly from the mold and placing the slip ring assembly in a cooling fixture.

9. A method according to claim 8 including the step of post curing the slip ring assembly in a cooling fixture for a substantial period of time at a temperature substantially above ambient temperature.

10. A method according to claim 9 including the step of allowing the slip ring assembly to cool to room temperature in said cooling fixture.

11. A method according to claim 10 including the further steps of removing the slip ring assembly from the cooling fixture and deflashing the slip ring assembly.

12. A method according to claim 11 including the step of lightly machining the faces of said slip rings to remove insulating material and to finish slip rings to specified dimensions.

13. A method for making a slip ring assembly comprising the steps of:

welding to one face of each of a plurality of varying diameter concentric conducting rings the enlarged heads of a plurality of electrically conducting studs, said enlarged heads having a diameter greater than the radial dimension of said rings;

positioning a plurality of said rings within grooves inscribed in a first mold section in an accurately spaced concentric arrangement with respect to each other;

surrounding said plurality of said rings radially interiorly thereof with insulating material;

placing insulating material in the spaces between said concentrically spaced rings and radially outwardly thereof, said insulating material overlying a portion of said enlarged heads of said studs axially to one side thereof;

positioning plies of insulating material axially of said rings and said insulating material aligned to permit passage of said studs through holes in said plies and overlying a portion of said enlarged heads of said studs axially to the other side thereof;

closing a second mold section on said first mold section; and heating the assembly in said mold sections until the assembly is cured with said insulating material axially surrounding said enlarged heads for mechanically interlocking said studs in said insulating material.

* * * * *